United States Patent [19]

Finn

[11] 4,134,437

[45] Jan. 16, 1979

[54] BILLFOLD BILL FILE

[76] Inventor: Donald J. Finn, 5100 Sea Rancho Club #712 N. Ocean Blvd., Ft. Lauderdale, Fla. 33308

[21] Appl. No.: 746,196

[22] Filed: Nov. 30, 1976

[51] Int. Cl.[2] ..... A45C 1/00

[52] U.S. Cl. ..... 150/38; 40/359

[58] Field of Search ..... 150/38, 39, 52 R; 40/359

[56] References Cited

U.S. PATENT DOCUMENTS

| | | | |
|---|---|---|---|
| 1,749,020 | 3/1930 | Curry | 150/38 |
| 1,761,976 | 6/1930 | Barnes | 150/38 |
| 1,765,730 | 6/1930 | L'Enfant | 150/38 |
| 2,119,122 | 5/1938 | St. Thomas | 150/38 |
| 2,249,558 | 7/1941 | Green | 150/38 |
| 2,871,901 | 2/1959 | Nash | 150/39 |
| 3,241,588 | 3/1966 | Osher | 150/39 |
| 3,565,148 | 2/1971 | Miller | 150/39 |
| 3,845,800 | 11/1974 | Lookatch | 150/39 |
| 4,004,690 | 1/1977 | Giarritta | 150/39 |

*Primary Examiner*—Ro E. Hart

*Attorney, Agent, or Firm*—Hiram A. Sturges

[57] ABSTRACT

A billfold file for currency bills in a billfold, attached or unattached thereto, for quick, accurate filing. Parallel, rectangular, foldable sheets with bill-receiving areas therebetween, each sheet having an index tab labeled with the bill denomination, the sheets being scored for easier folding, or unscored. The sheets being interconnected at a place facilitating folding and bill insertion.

9 Claims, 7 Drawing Figures

BILLFOLD BILL FILE

BACKGROUND OF THE INVENTION

It has been common in the experience of people handling bills of various denominations from a billfold that there is a very real chance for error in the process of pulling out a bill in a hurry, thinking it is a one denomination, when actually it is another. In a rush of modern life this happens frequently, particularly to those people who do business itself from their billfold, and in which case they may make many dozens of transactions even in a very short space of time.

The concept of a billfold file has many problems. When the sheets of material of the file are of adequate strength to be seeming to some laymen to be reasonably durable and useable, then they are excessively stiff for the necessary bending needed. Such bending is particularly difficult with thicker file panels or sheets when one considers the gradually increasing radius of bend that is necessary when the bill areas are filled to a substantial total thickness of file and contents.

When the billfold is full, the bending of such a file requires substantial freedom of movement of the parts of the file with respect to the other parts of the file and also with respect to the billfold itself in order to permitting bending as the billfold is folded.

It is, therefore, an object of this invention to provide a way of securing the parts of the file together so that they do not easily fall out of a billfold and so that they maintain order and yet at the same time permit the necessary bending of the various parts with respect to each other and with respect to the billfold itself during folding and unfolding.

A particular object is to make possible the use of material for the sheets or panels of the file which is of substantial thickness as made possible by the concept of making these panels of lesser thickness along scoring lines in the areas where bending will occur.

Another object is to make the file of oblong, rectangular shape so as to fit in a billfold and also to make indexing tabs on a file of a size for fitting within the outlines of the billfold so as to prevent damage and provide long life for the billfold file system.

A further object is to provide the options for the customer of a billfold file which can be completely removed from the billfold if the customer chooses, or else a billfold file of the type which is stitched into the billfold or otherwise secured to the billfold for permanent attachment thereto.

A particular object is to provide the indexing tabs with indicia indicating the size and denomination of the bills in the bill area to which each applies.

SUMMARY OF THE INVENTION

A billfold file for receiving currency bills, the file being adapted to be carried in a billfold for quick, easy and accurate storage and removal of bills, the file having a plurality of panels of flexible material, said panels being disposed in substantial parallelism for providing bill receiving areas therebetween, means for attaching the panels together at portions of each of said panels, the attachment portions being disposed exteriorly of the bill-receiving areas is a broad concept of this invention.

Another feature is the provision of the attachment portions of each of the panels in the same part of the billfold file, such part being at the center between the ends of the generally oblong rectangular panels where the amount of movement of panels with respect to each other is at minimum in the case of a file for use with a billfold of the type which is folded once in the center, the same area at the center between the ends of the file also being a position of least movement of the panels with respect to each other when the billfold file is to be used with a billfold which is folded twice, since the central part of such a billfold is not moved with respect to the remainder during folding of the ends of such a billfold inwardly for achieving the lapping relationship of the ends of such a billfold used for compact storage.

Another concept of the invention is to make possible the use of flexible panels which have substantial thickness so as to hold their shape well in hard use and yet to provide a flexibility of the panels, making possible easy folding by means of making the panels thin along scoring lines, or, in other words, linear areas in spaced parallelism, such linear areas being of lesser panel thickness, and such linear areas extending transversely of the oblong rectangular panels and extending from top to bottom thereof, with the exceptions of portions of the panels which form tabs.

The new billfold file has tabs on each panel which are staggered with respect to each other for visibility of all tabs when the file is extended and looked at from a forward side, so that number indicia on the tabs can be easily read so as to see the denomination of the bill currency to be placed behind each of the tabs in a respective bill storage area.

A further objective is to provide a file as described which is attached to a billfold, such as by means of having a protrusion extending downwardly from each panel, the protrusions being stitched into the lower edge of a billfold, lengthwise of an oblong billfold and preferably using the same stitching with which the sides of the billfold are secured.

A still further objective is to provide for the securing of the panels together by means of heat sealing of thermoplastic panels of what is called "living plastic", meaning semi-soft plastic.

A further object is to provide flexibility and foldability and durability by forming the panels of thermoplastic material such as polypropolene, although other materials could be used such as thin rubber, the thickness of the panels being ten thousandths of an inch so that scoring of the panel is not needed although scoring, as above described, can be used if a thickness of the main area of the panel is as great as fifteen thousandths of an inch.

Yet another object is to provide for the attachment of the billfold file to the billfold by either stitches, rivets or other mechanical means or else by heat sealing a thermoplastic billfold file assembly to the billfold, especially in the case in which a thermoplastic billfold is involved.

A particular object is to provide the concept of panel material which is extremely flexible such as polypropolene, which is in effect a "living hinge" and adapted to flex almost indefinitely without cracking.

Another objective is to provide a billfold file that is itself so extremely thin as to add an extremely negligible thickness to a billfold.

I am aware of a U.S. Pat. No. 1,749,020 issued Mar. 4, 1930 to J. A. Curry, titled: BILLFOLD. In this patent there are two inner panels separating the interior into three longitudinal compartments in which bills of three denominations are to be kept, but with the disadvantage that the inner panels are stitched to the outer panels completely around three sides of the inner panel. This makes folding very difficult, as above described, because of the tendency of the inner panels to "bunch up" because they are "tied-in".

A second disadvantage was that the number indicia to indicate which size bill is involved were disposed a substantial distance down beyond the upper edge of the billfold, requiring the undesirable necessity that parts of the forward panel of the billfold must be cut away in order to see indicia on the panels therebehind.

A further disadvantage was that the several bill pockets formed did not completely overlap with each but only partially overlapped, thereby necessitating a billfold of unusual length. Unusual length is undesirable because it will not easily fit into a pocket. We all have had the experience that a double fold billfold filled with the usual common number of bills and identification information, etc., is bulky. Being bulky, it fits in a pocket none too easily. To make a billfold extra long to accommodate partially staggered bill areas defeats a most desirable objective.

Since completing my invention I have been made aware of a patent issued to a W. H. St. Thomas on May 31, 1938 and numbered U.S. Pat. No. 2,119,122, titled: "CONTAINER". This patent had only one panel between its forward and rearward outside panels. Where only one panel is involved, then very little separation can be accomplished and there was no plan for indicia panels at all, but only one single interior panel. It is common that a single interior panel be stitched all around its edge. I realize that St. Thomas, et al, teaches the stitching of only one end of the interior panel, but his stitching proposed at a bottom point would be right where a bend would be if his were a two-fold billfold, but his billfold is a one-fold billfold as distinguished from the billfold of this invention, which is a two-fold billfold. So stitching at his bottom place would be in the wrong place if he attempted to fold his billfold into three parts by a two-fold method. His interior panel is made of material so thick that it must be skived at an edge to make it thin enough to be practical to stitch between the outer panels. Such skiving is expensive in terms of labor. I propose inner panels thin enough that many panels can be used without any expensive skiving operations. I also propose that the inner panels have indicia, absent in St. Thomas.

I am further aware of a U.S. Pat. No. 2,871,901 issued Feb. 3, 1959 to D. J. Nash, entitled: "WALLET AND REMOVABLE PASS CASE THEREFOR". However, the only panels bearing indicia only extend one-half the length of the billfold. In addition, they are secured together by a very bulky pin and fastener assembly which gives undesirable width-bulk. So it will not receive flat currency bills and there is no intention of storing currency bills in it, but rather automobile registration and other short informational items. In addition, the method of securing reduces the available space between panels.

In the prior art it has been a common situation for a billfold to have a single separating panel stitched at both ends and around the bottom so as to secure it to the billfold. It has been proposed in the prior art, however, that a plurality of panels be used with the panels having currency indicia but not with the bill-receiving areas of the panels directly disposed one behind another, which is a necessary concept of my invention for making it possible for the total length of the billfold when unfolded to be at a needed minimum. Billfolds are too bulky by nature and lesser length is very desirable.

In addition the only proposal in the prior art for multiple panels bearing indicia of currency has been a construction in which the panels have been stitched to the billfold at both ends of the panels and at the bottom sides thereof, making the panels fixed whereby they would tend to bunch up and wrinkle in a billfold at a time of folding, even if the billfold were empty of bills. The "bunching up" would even be greater if bills were between the panels.

In the prior art it has been proposed that the currency number indicia on currency bill panels be disposed a substantial distance below the upper edge of the billfold. However, this requires the undesirable necessity that parts of the forward panel of the billfold must be cut away in manufacture in order that the user can see the indicia on the panels therebehind.

It is, therefore, an object of this invention to provide the indicia on the tops of the panels where they can be easily seen by looking in the upper side of the billfold between the forward and rearward walls thereof.

DESCRIPTION OF THE PREFERRED EMBODIMENT

Figure 1:
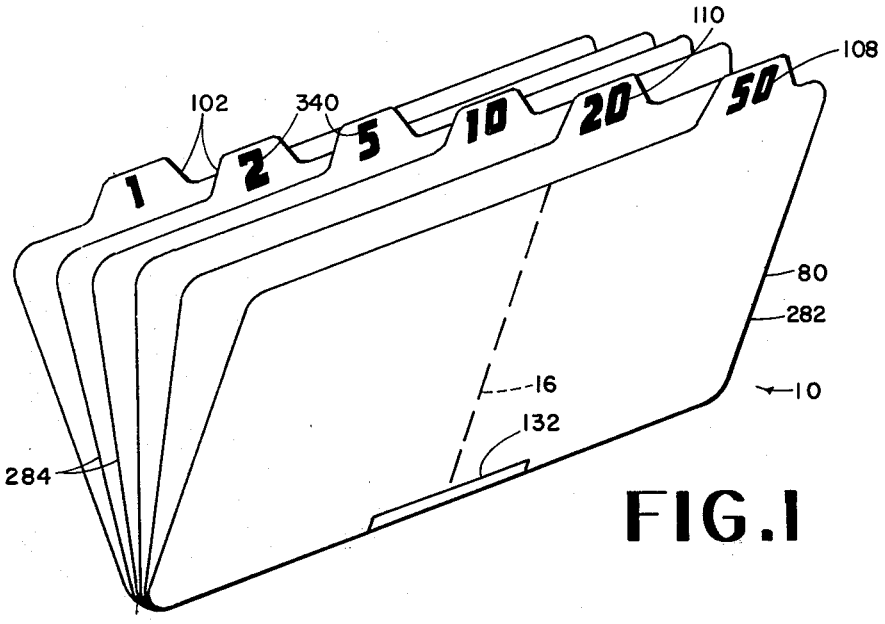
FIG. 1 is a perspective view of a billfold file of this invention of the type adapted for use in a billfold of the kind which is folded once in the middle, the panels of the file being spread apart for indicating currency bill areas therebetween.
Figure 2:
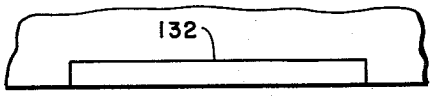
FIG. 2 is a detail of the central bottom portion of the file of FIG. 1 showing an area in which the panels are heat-sealed together.
Figure 3:
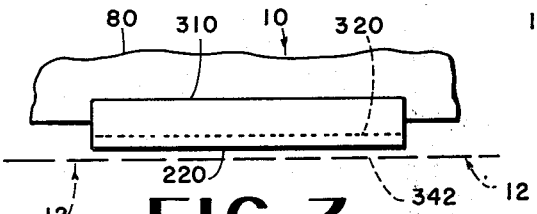
FIG. 3 is a diagrammatic view showing a modification of the file of FIG. 1 in which the panels have a downwardly extending protrusion, a dotted line of stitches indicating a place where the protrusion can be stitched to the edge of a billfold between the panels, another dotted line indicating the position of the lower edge of the outside of a billfold. An area in which the panels are sealed together is also shown.
Figure 4:
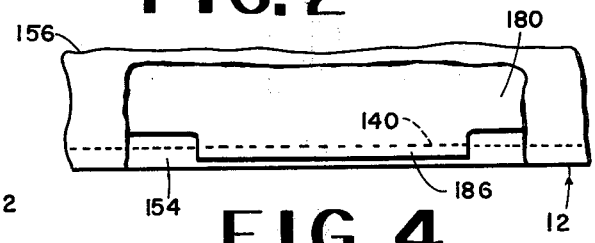
FIG. 4 is a side elevation of a bottom central portion of a billfold, shown with a file of this invention therein of a modified form having a downwardly extending protrusion which is secured to the lower edges of the billfold by a row of stitching, a portion of the closer side cover of the billfold being broken away for showing the billfold file therein.
Figure 6:
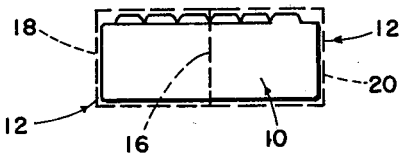
FIG. 6 is a diagrammatic view of a billfold and billfold file assembly in which the billfold is shown in dotted lines, the billfold being of the sort that is folded once at the center, the billfold file therein being shown in full lines.

The billfold file of this invention is generally indicated at 10 in FIG. 1, and is for the purpose of receiving currency bills within a billfold, generally indicated at 12 in FIG. 4, and indicated in dotted lines at 12 in FIGS. 3 and 6. The billfold being one of a type which is folded only once in its center, along a dotted line 16 seen in FIG. 6, which is transverse to the elongation of the billfold, and disposed at the middle between the ends 18 and 20 of the billfold.

Figure 5:
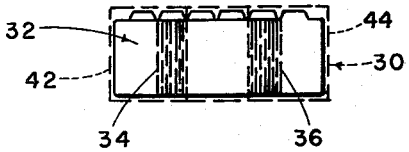
FIG. 5 is a diagrammatic view showing the outlines of a billfold in dotted lines, the billfold being of the type that is folded twice, the billfold having a file of this invention disposed therein, the file having panels which are provided with linear areas of lesser thickness disposed in parallelism and extending transverse to the length of the file at two points at which the file is bent during folding of the billfold.

Distinction is to be made between the type of billfold which is shown at 12 and which is folded only once along the line 16 and a different type of billfold which is shown in FIG. 5, and generally indicated at 30, and partially shown in dotted lines, the latter billfold being of the type that is folded twice along the dotted lines 34 and 36 of FIG. 5, and it will be understood that the lines 34 and 36 are approximately equidistant from a center of the billfold as measured between the ends 42 and 44 of the billfold. This folding of a billfold of the type that is folded twice is better seen as regards the file 30 in FIG. 6 where the folding areas are more accurately shown in detail.

Figure 7:
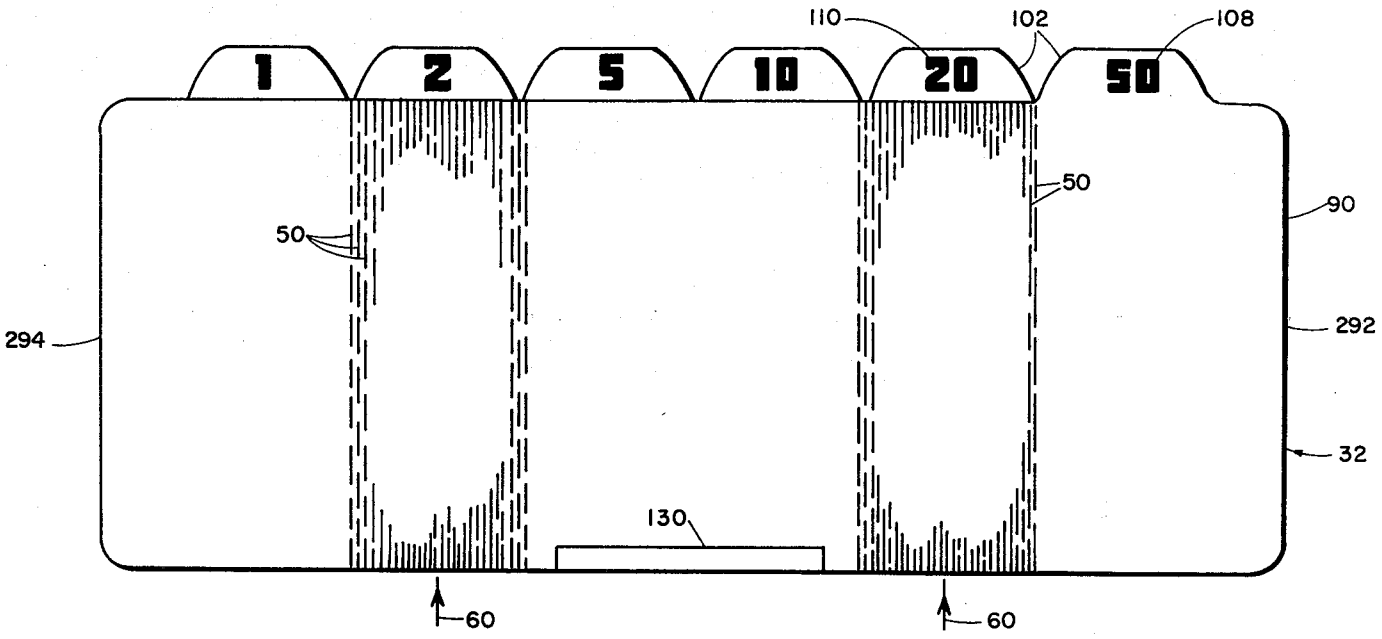
FIG. 7 is a frontal elevation of a billfold file of this invention in the modified form used in a billfold of the type that is folded twice, parallel spaced lines of lesser thickness of the closer panel of the billfold being diagrammatically shown incompletely, but sufficiently to indicate that the lines can be of any suitable number and can extend completely across the panel, with the exception of a tab portion of the panel. The billfold file of FIG. 7 is heat-sealed in the central portion of its bottom edge.

In FIG. 7 many score lines 50 are spaced apart each a fraction of an inch on either side of a fold-center. Such right and left fold-centers 60 would be disposed upwardly from arrows labeled 60 in FIG. 7, although the actual folding would take place a considerable distance to each side of the arrows 60 toward the ends and center of the billfold file. The score lines 50 can be of various depths, although a depth of scoring for causing the remaining portion of the sheet of plastic material numbered 80 in the case of the one fold file of FIG. 1, and numbered 90 in the case of the two fold file of FIG. 6, would be approximately 0.005 inch thickness for easy folding. Each of the layers or sheets 80 or 180 is scored and the scorings can be 1/16 inch apart although ⅛ inch scoring spacing will also work.

The purpose of the scoring 50 is to make possible easier folding since the presence of great quantities of bills disposed between the sheets 80 or 90 makes folding more difficult than when the file 10 or 30 is empty because of the increasing radius about which outer sheets 80 or 90 must bend when they are receiving many currency bills.

At the top of each sheet 80 or 90 is an upwardly projecting tab 102 having a numerical indicia thereon indicating the size of bills which are to be filed in the bill storage area between the sheet 80 or 90 bearing that indicia and the next sheet 80 or 90 disposed therebehind.

For example, indicia 50, shown in FIG. 7, at 108 indicates that fifty dollar bills are to be stored therebehind, while the indicia 20, shown at 110, indicates that twenty dollar bills are to be disposed there-behind.

In order to maintain the sheets 80 and 90 in position they are secured together by a suitable connecting means such as a heat seal, shown in FIG. 6, at 130, or a heat seal shown in FIG. 1, at 132, or a line of stitching shown in FIG. 4 at 140. These various securing means secure all of the respective sheets 80 or 90 of a billfold together, although the stitching 140 can serve an additional purpose.

In FIG. 4 the billfold 12 has a leather or plastic side indicated at 154, which can be called a back side and has a front side 156 parallel thereto and these two sides of the billfold are secured together by the stitching 140, which can also extend through portions of each of the sheets 180 of FIG. 4, which latter are similar to the sheets 80 of FIG. 1, or the sheets 90 of FIG. 6, with the exception that they have a downwardly protruding extension 186, extending a short distance toward each end of the respective sheet 180 from a center between the ends of the respective sheet 180, so as to give a substantial amount of extension material 186 for the stitching 140 to be firmly secured thereto to give strength.

A different kind of an extension can be shown at 220, which protrudes downwardly from the respective sheet of material 80 or 90 directly from a center between the ends of the respective sheets 80 or 90, such ends being shown at 282 and 284 in the case of the file 10 of FIG. 1, and at 292 and 294 in the case of the file 32 shown in FIGS. 5 and 7.

In FIG. 3 extension 220 is simply a part of the respective sheet 80, but since all of the extensions 220 of the file 10 of FIG. 3 are heat sealed together, they, therefore, augment and add to the amount of attachment of the sheets 80 of FIG. 3, since the sheets 80 of FIG. 3 are also secured together in an area above the extensions 220, as shown at 310.

In FIG. 3 the extensions 220, being heat sealed together, are in addition stitched with a row of stitching 320 extending transversely therethrough and spaced upwardly from the bottom 324 of the respective billfold 12, the stitching 320 also being a part of the stitching which holds the sides of the billfold together.

The tabs of the file sheets 80 of FIG. 1 are also given the numeral 102 collectively and the numerical indicia thereon are given the general numeral 340, and it will be understood that the tabs 102 and indicia 340 of FIG. 1 are the same as previously described as regards the tabs 102 and indicia respectively 108 and 110 in each respective case of FIG. 7.

I claim:

1. A billfold file comprising a panel assembly for receiving currency bills, said panel assembly being for carrying inside a billfold for quick, easy and accurate storage and removal of bills, said panel assembly comprising: a plurality of vertical panels of flexible material, said panels being disposed in substantial parallelism, each two adjacent one of said panels having a vertical bill-receiving area therebetween, said bill-receiving areas each being open at their upper sides, said panels each being of a length more than double the height thereof for providing said bill-receiving areas with ability to receive unfolded currency bills therein, panel attaching means attaching said panels together at only attachment portions of each of said panels disposed exteriorly of said bill-receiving areas, said attachment portions being on one of the long sides of each of said panels and sufficiently close to the center of said panels as not to be in bend areas when said panel assembly is bent transversely of its length at two spaced bend areas so that said bend areas divide said panel into three portions each approximately one-third of the length of said panel assembly and when said bending has reached a point such that said right and left panels are approximately parallel with said central panel then said panel attachment portions will not be in said two bend areas even at times when said bill-receiving areas each have two currency bills therein, each of said panels having an index tab extending upwardly therefrom, each tab having a different currency number indicia means thereon.

2. The billfold file of claim 1 in which said means for attaching said panels together is heat-sealing.

3. The billfold file of claim 1 in combination with the billfold in which said billfold file is disposed inside the billfold.

4. The billfold file of claim 1 in further combination with a billfold, means securing said file to said billfold.

5. The billfold file of claim 4 in which said billfold has an open upper side and in which said billfold file has an open upper side and in which said means securing said billfold file to said billfold is disposed at a central position between the ends of said billfold file and of said billfold.

6. The billfold file of claim 1 in which said panels are provided with a plurality of parallel linear areas of lesser thickness than the remainder of the respective panel and which latter extend transversely of the length of the respective panel at a place where it is desired that the panel bend freely.

7. The billfold file of claim 1 in which said panels are formed of semi-soft polypropolene material of a gauge of approximately 0.010 inch.

8. The billfold file of claim 1 in which said panels are formed of material of semi-soft polypropylene which is of a thickness of approximately 0.015 inch excepting in areas where elongated parallel lines of lesser thickness are provided extending transversely with respect to a respective panel in an area where it is desired for a panel to bend as a billfold is opened and closed, the spacing of the linear areas of lesser thickness being for example approximately 1/16 inch or ¼ inch, such linear areas of lesser thickness being a thickness of approximately 0.005 inch thickness.

9. The billfold file of claim 1 in further combination with a billfold of the kind which has two spaced fold-lines between its ends and in positions on the right and left of each other, said billfold having an open upper side, said file being inside said billfold, said attachment portion being at the bottom of said panels and between the two folds of said billfold.

* * * * *